US006843668B2

(12) United States Patent
Zenaboni

(10) Patent No.: US 6,843,668 B2
(45) Date of Patent: Jan. 18, 2005

(54) DEVICE FOR CONNECTING AN ELECTRICAL LOAD TO AN INSULATED POWER SUPPLY CABLE

(75) Inventor: Luca Zenaboni, Pogliano Milanese (IT)

(73) Assignee: Nemo S.p.A., Rovellasca (IT)

( * ) Notice: Subject to any disclaimer, the term of this patent is extended or adjusted under 35 U.S.C. 154(b) by 0 days.

(21) Appl. No.: 10/684,381

(22) Filed: Oct. 15, 2003

(65) Prior Publication Data

US 2004/0082209 A1 Apr. 29, 2004

(30) Foreign Application Priority Data

Oct. 24, 2002 (IT) ..... MI2002A2257

(51) Int. Cl.[7] ..... H01R 13/44

(52) U.S. Cl. ..... 439/133; 139/131; 139/135; 139/426; 139/443

(58) Field of Search ..... 439/131, 133–135, 439/426, 446, 404

(56) References Cited

U.S. PATENT DOCUMENTS

| | | | | |
|---|---|---|---|---|
| 3,142,542 A | * | 7/1964 | Schwarzenbek et al. | 422/143 |
| 4,288,684 A | * | 9/1981 | Katou et al. | 392/335 |
| 4,386,313 A | * | 5/1983 | Venaas et al. | 324/110 |
| 6,406,323 B2 | * | 6/2002 | Chung Long Shan | 439/395 |

* cited by examiner

*Primary Examiner*—Truc Nguyen
(74) *Attorney, Agent, or Firm*—Guido Modiano; Albert Josif; Daniel O'Byrne

(57) ABSTRACT

A device for connecting an electrical load to an insulated power supply cable, comprising conducting elements that can be electrically coupled to an electrical conductor of an insulated cable and form at least one contact for connection to a connector for an electrical load; the conducting elements are accommodated within an outer enclosure made of electrically insulating material constituted by shells that can be fastened together. The device further comprises safety elements that are adapted to prevent the connector from being recoupled to the contact once uncoupling has been performed inside the outer enclosure.

16 Claims, 8 Drawing Sheets

DEVICE FOR CONNECTING AN ELECTRICAL LOAD TO AN INSULATED POWER SUPPLY CABLE

BACKGROUND OF THE INVENTION

The present invention relates to a device for connecting an electrical load to an insulated power supply cable.

As is known, especially in overhead lighting systems, insulated power supply cables are currently used to which it is possible to apply a terminal that allows the connection of a connector that is, for example, associated with the luminaire.

U.S. Pat. No. 5,586,905 discloses a device that in practice has a body made of electrically insulating material, which contains a fork made of metal that allows to punch through the insulating sheath of the power supply cable in a region that is internal to the body, which is closed irreversibly onto the cable, so as to not allow its reopening and so as to be locked onto the cable.

Furthermore, the enclosure is provided with a blade-type slot, which allows to insert from outside an electrical connector that is connected for example to the luminaire.

An identical solution is shown in EP 1 074 072, the only difference being that the electrical connector for connecting the lamp body or the like is accommodated in a containment enclosure made of insulating material, which is provided with means for snap coupling to the container body that is connected to the electrical power supply cable.

All the solutions of the prior art are provided with connectors that are connected reversibly to the contact element that has punched through the electrical power supply cable, and therefore the user can disconnect such connectors and reconnect them, with the risk of causing plays or damage with this operation, but most of all with the risk of connecting an electrical load that does not match the characteristics of the electrical power supply cable.

Accordingly, this kind of solution may cause possible drawbacks arising from the fact that the user can remove the connector and perform a new electrical connection, which might be provided improperly.

SUMMARY OF THE INVENTION

The aim of the invention is to solve the problem noted above, by providing a device for connecting an electrical load to an insulated power supply cable that prevents the application of the connectors once the outer enclosure made of electrically insulating material connected to the power supply cable has been assembled and completed.

Within this aim, an object of the invention is to provide a device that absolutely prevents unauthorized individuals from connecting electrical loads to the power supply cable.

Another object of the present invention is to provide a device that thanks to its particular constructive characteristics is capable of giving the greatest assurances of reliability and safety in use.

Another object of the present invention is to provide a device that can be easily obtained starting from commonly commercially available elements and materials and is further competitive from a merely economical standpoint.

This aim and these and other objects that will become better apparent hereinafter are achieved by a device for connecting an electrical load to an insulated power supply cable, which comprises conducting means that can be electrically coupled to the electrical conductor of an insulated cable and form at least one contact for connection to a connector for an electrical load, such conducting means being accommodated within an outer enclosure made of electrically insulating material constituted by shells that can be fastened together, characterized in that it comprises safety means that are adapted to prevent said connector from being recoupled to said contact once uncoupling has been performed inside said outer enclosure.

BRIEF DESCRIPTION OF THE DRAWINGS

Further characteristics and advantages of the invention will become better apparent from the description of some preferred but not exclusive embodiments of a device for connecting an electrical load to an insulated power supply cable, which is illustrated by way of non-limitative example in the accompanying drawings, wherein.

DESCRIPTION OF THE PREFERRED EMBODIMENTS

Figure 4:
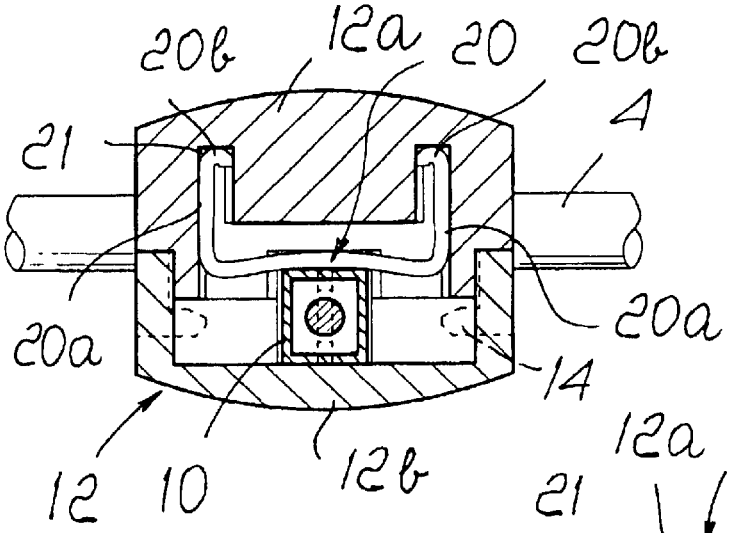
FIG. 4 is a transverse sectional view of the device, with the connector for an electrical load or the like inserted therein.
Figure 5:
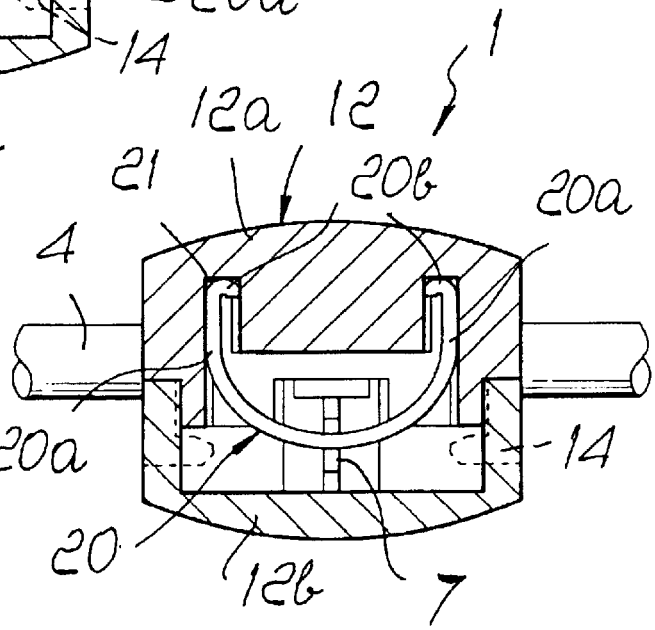
FIG. 5 is a transverse sectional view of the device, with the connector removed.
Figure 1:
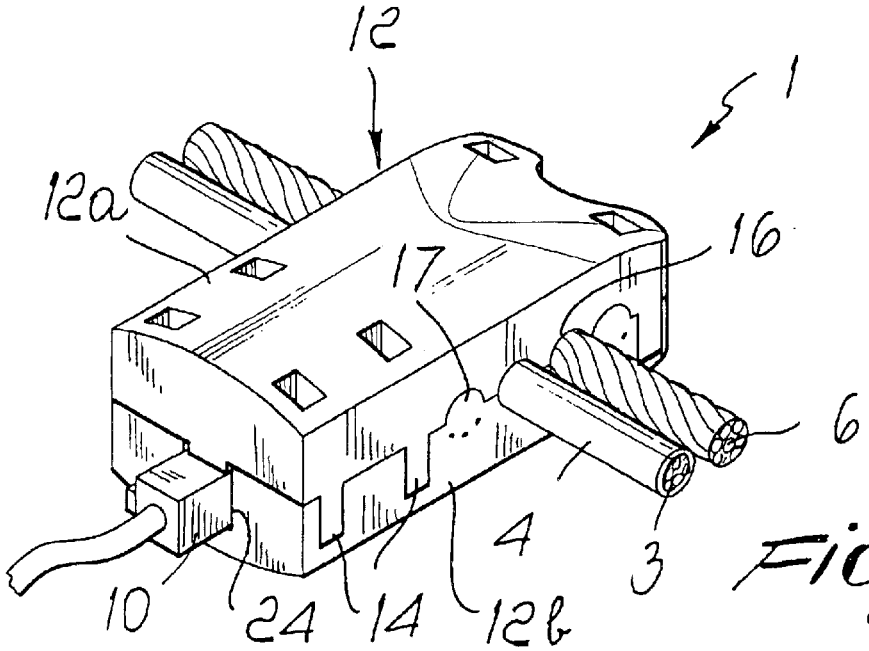
FIG. 1 is a schematic perspective view of a first embodiment of the device for connecting an electrical load applied to an insulated power supply cable.
Figure 2:
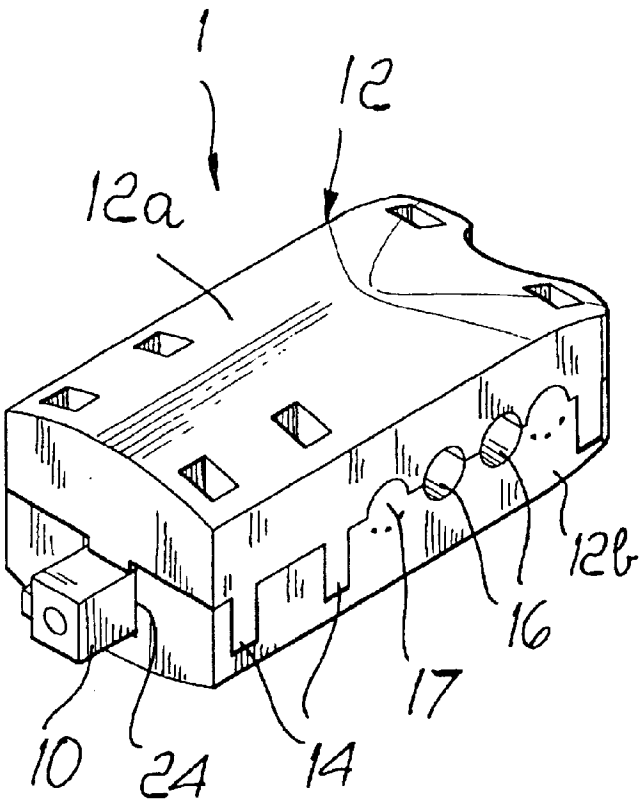
FIG. 2 is a schematic perspective view of the device of FIG. 1 in the closed condition.
Figure 3:
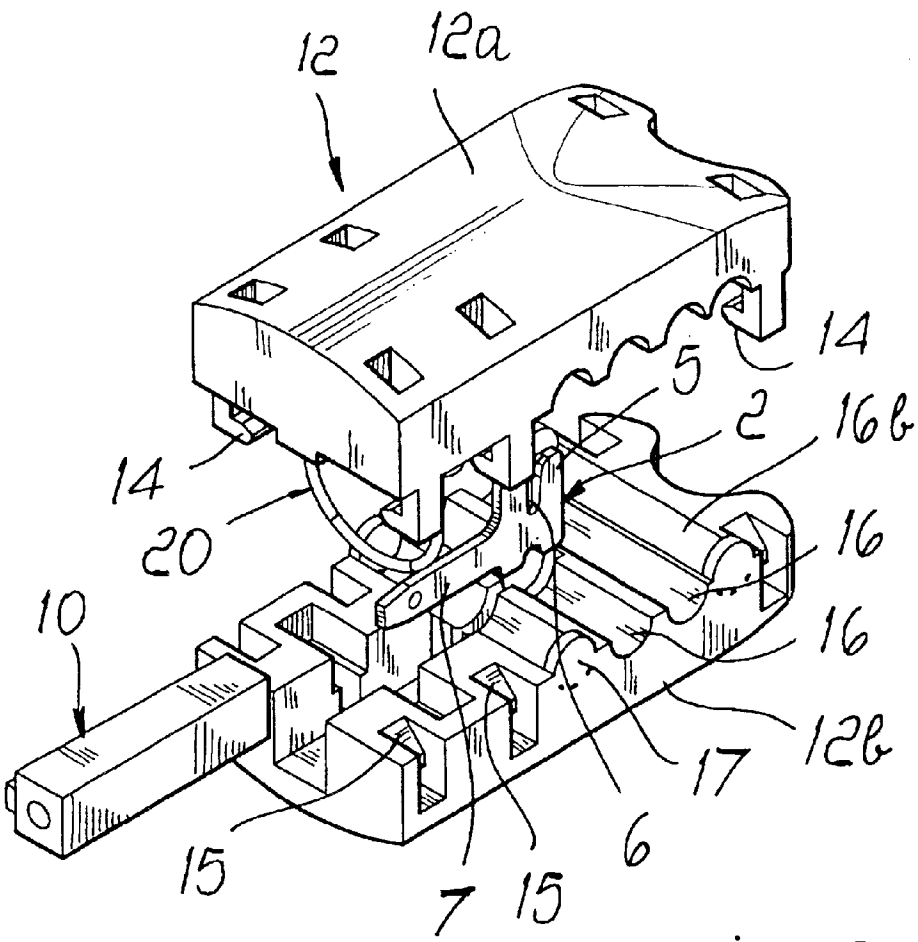
FIG. 3 is an exploded perspective view of the device.
Figure 7:
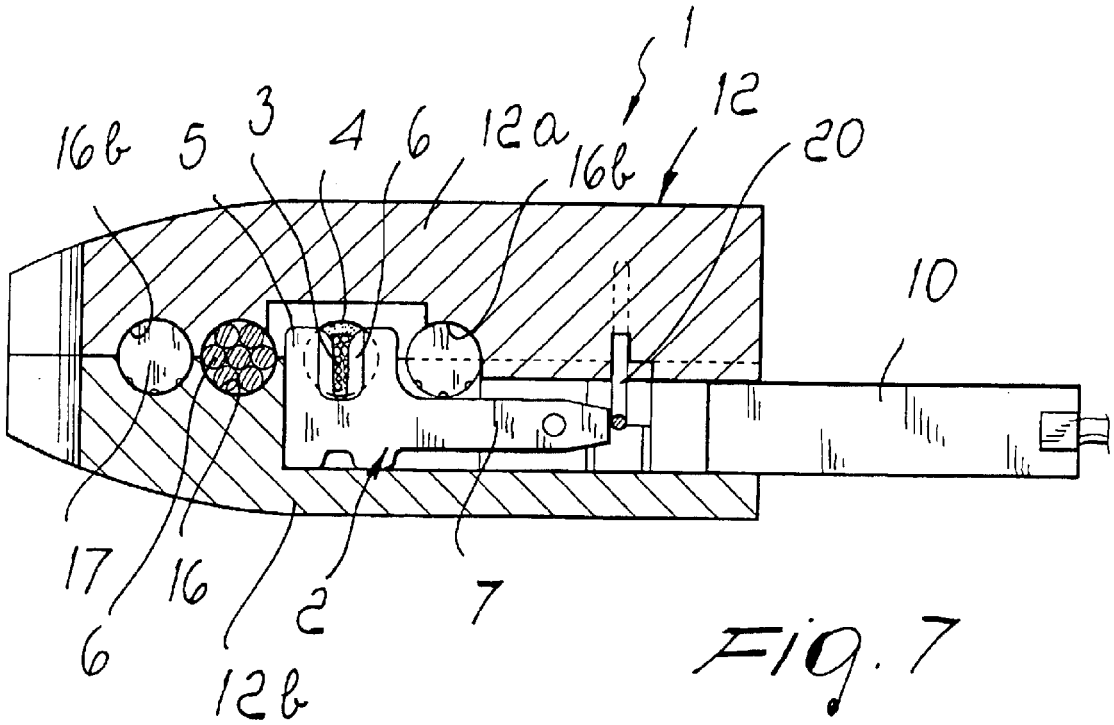
FIG. 7 is a longitudinal sectional view of the device, with the connector removed.
Figure 6:
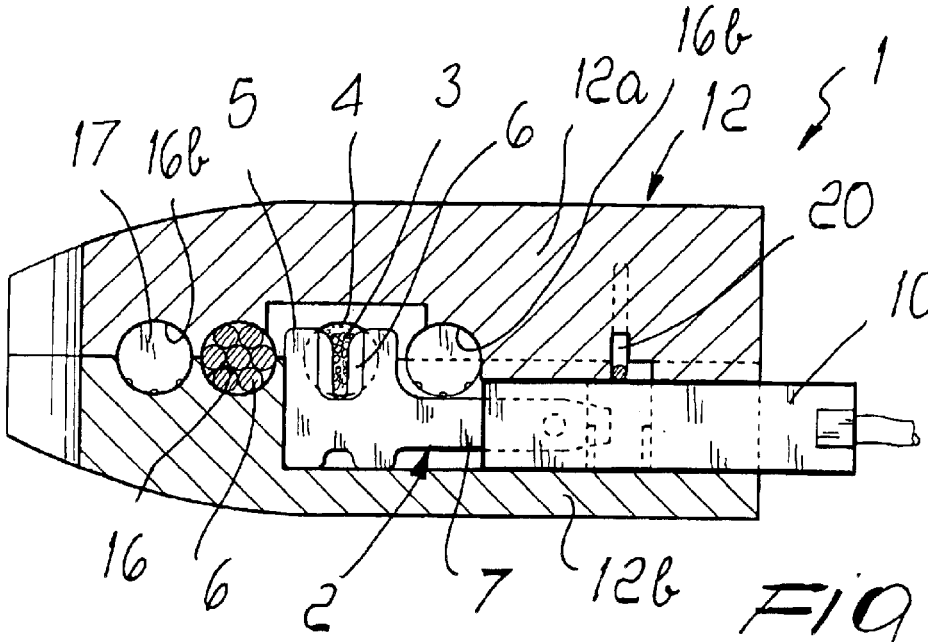
FIG. 6 is a longitudinal sectional view of the device, with the connector inserted therein.
Figure 9:
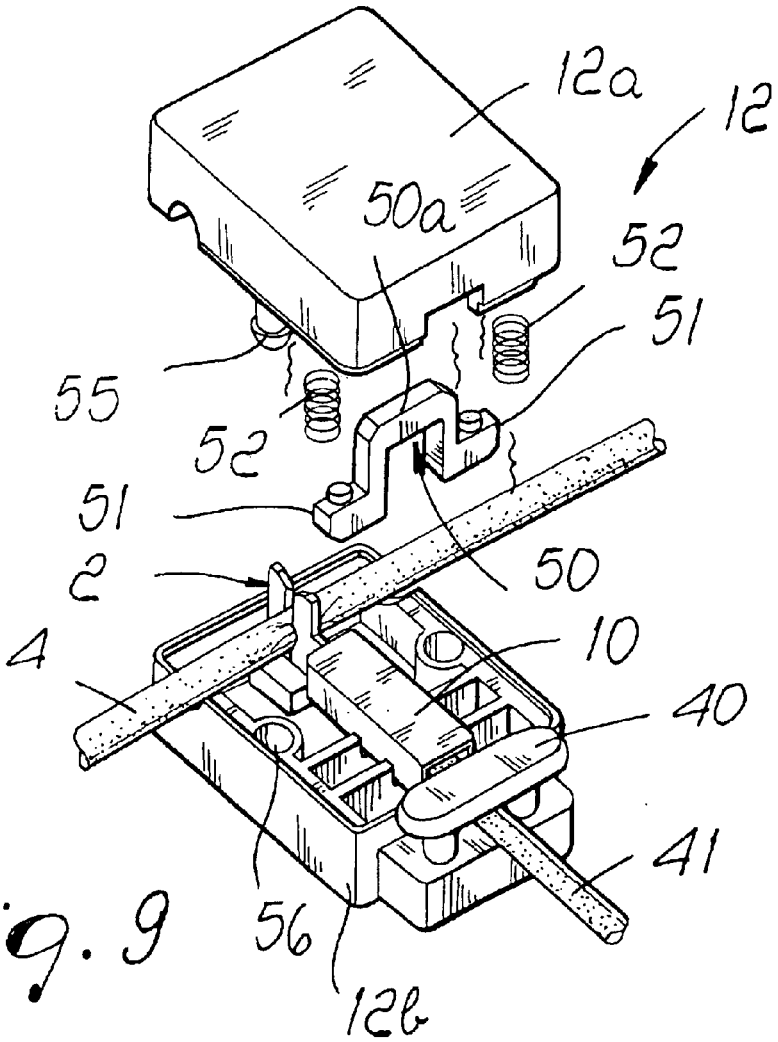
FIG. 9 is an exploded view of the device of FIG. 8.
Figure 8:
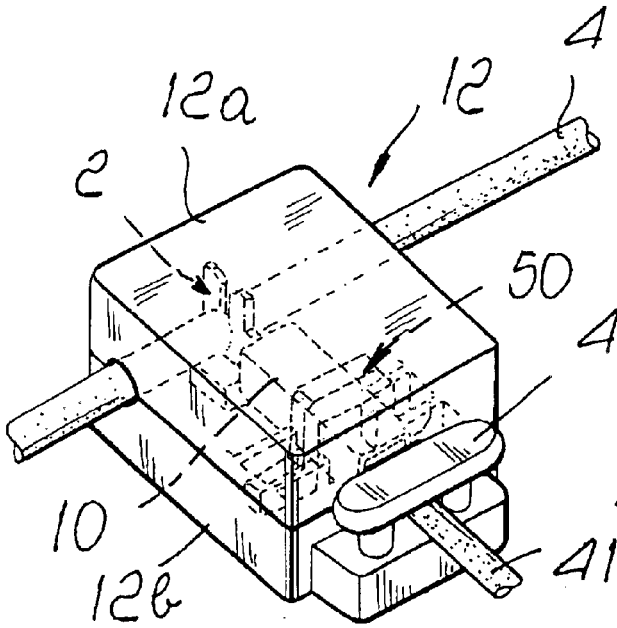
FIG. 8 is a perspective view of a second embodiment of the device according to the invention.
Figure 10:
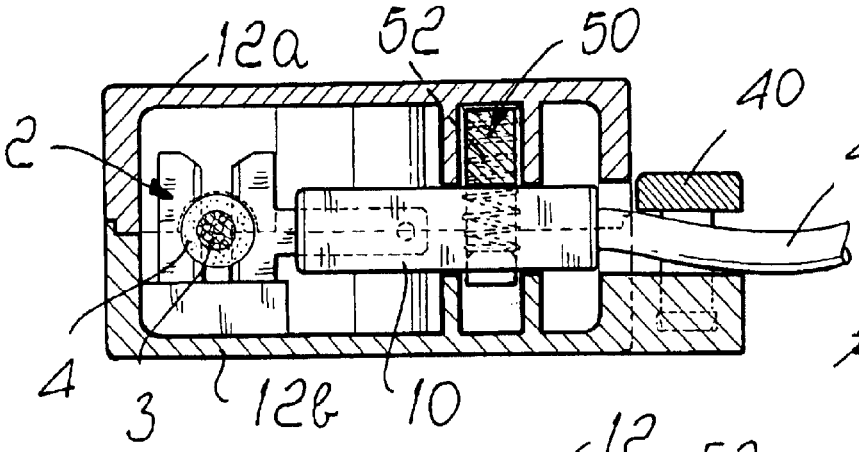
FIG. 10 is a longitudinal sectional view of the device of FIG. 8, with the connector inserted therein.
Figure 11:
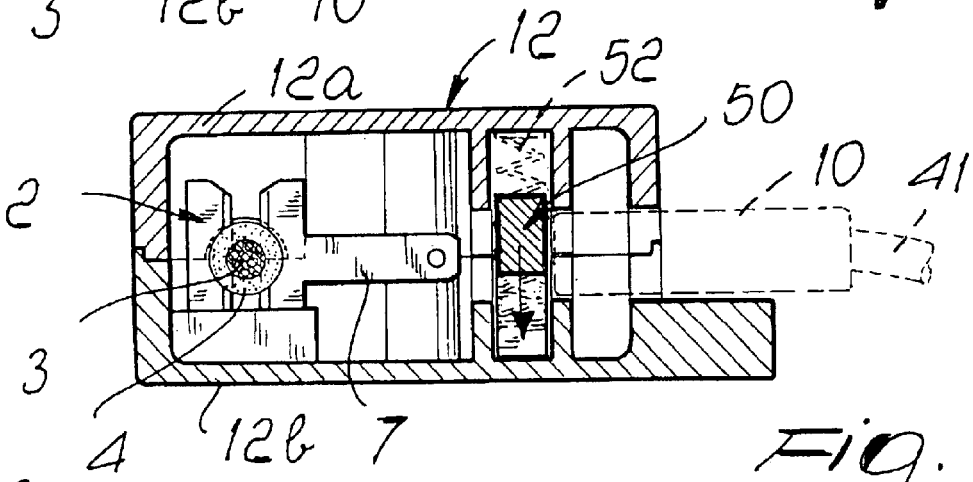
FIG. 11 is a longitudinal sectional view of the device of FIG. 8, with the connector removed.
Figure 12:
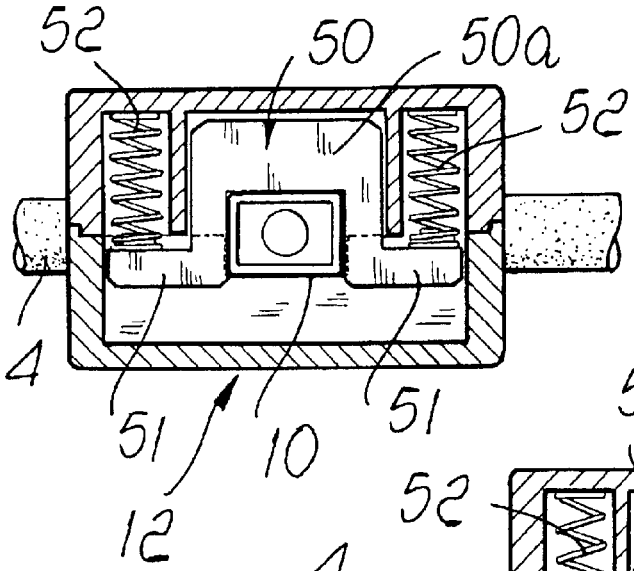
FIG. 12 is a transverse sectional view of the device of FIG. 8, with the connector inserted therein.
Figure 13:
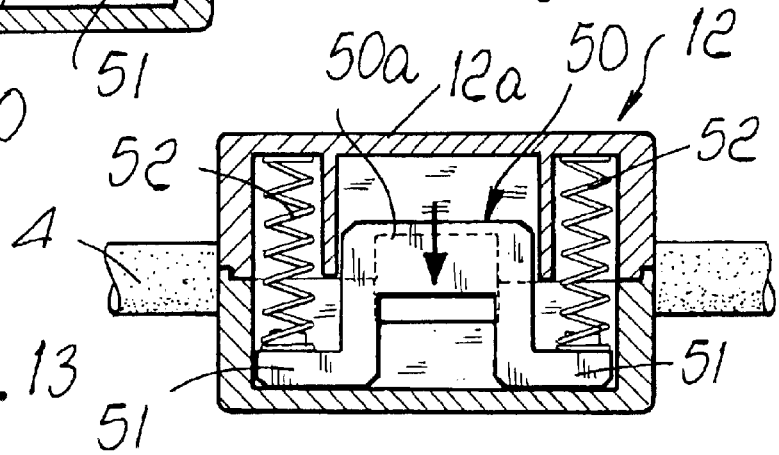
FIG. 13 is a transverse sectional view of the device of FIG. 8, with the connector removed.
Figure 15:
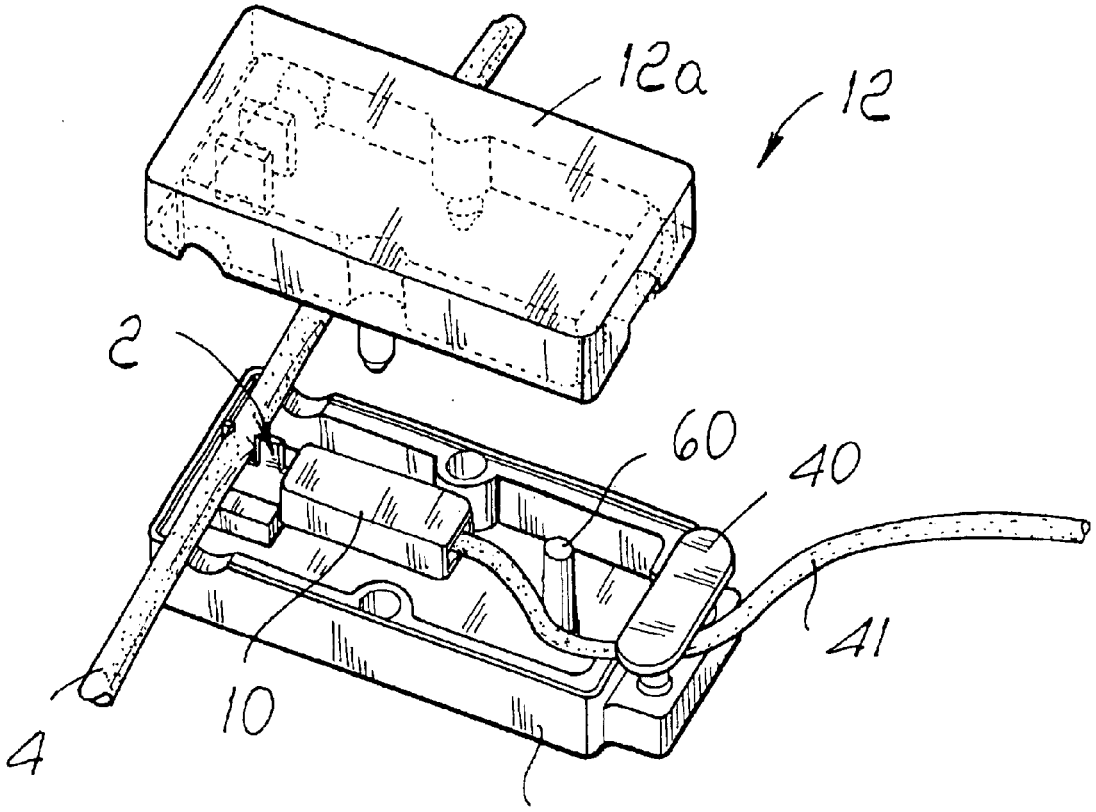
FIG. 15 is an exploded perspective view of the device of FIG. 14.
Figure 14:
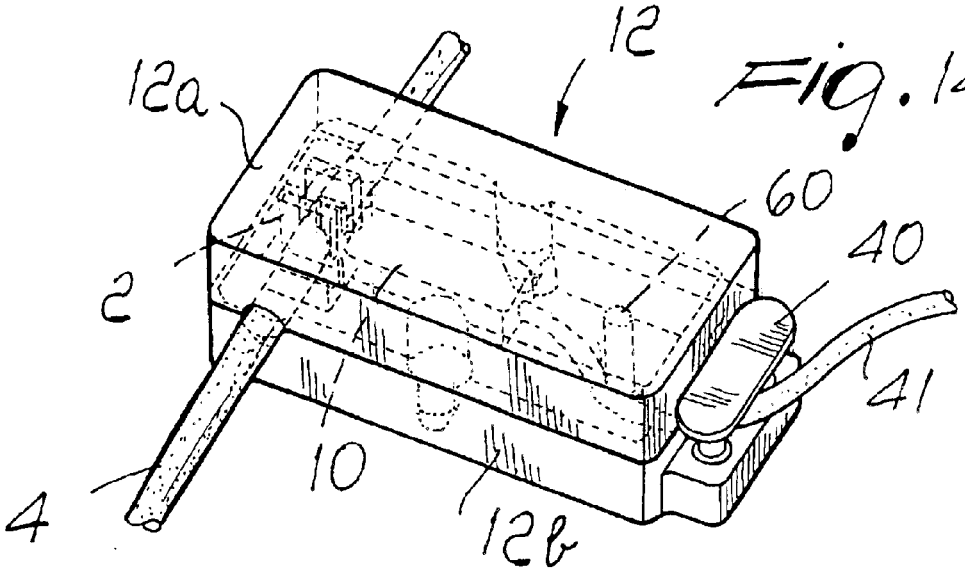
FIG. 14 is a perspective view of a third embodiment of the device.
Figure 16:
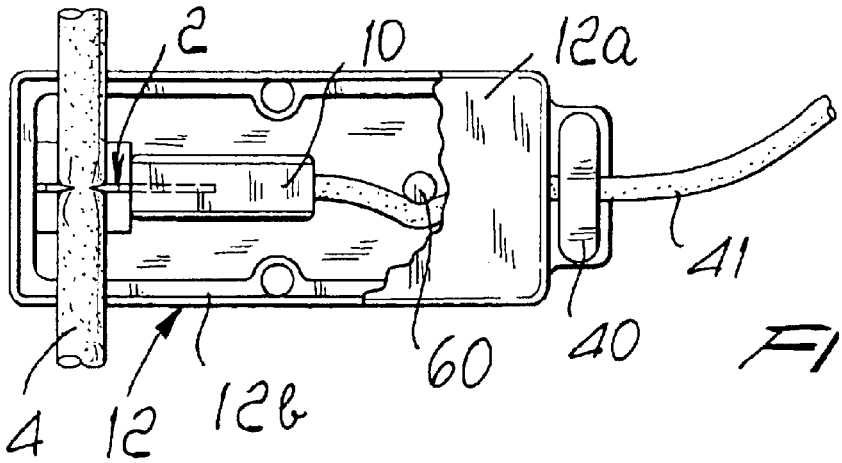
FIG. 16 is a partially cutout view of the device of FIG. 14, with the connector inserted therein.

With reference to the figures, and particularly to FIGS. 1 to 7, the device for connecting an electrical load to an insulated power supply cable, generally designated by the reference numeral 1, comprises conducting means 2, which can be electrically coupled to the electrical conductor 3 of an insulated cable 4.

In greater detail, the conducting means 2 form a fork-like portion 5, which provides a notch 6 for accommodating the cable 4, punching through its part made of insulating material and consequently providing an electrical connection between the electrical conductor 3 and the conducting means 2.

The conducting means have a contact 7, which is preferably blade-shaped and can be electrically connected to a connector 10, which is preferably of the Faston type and is connected to an electrical load, which can be constituted, for example, by a luminaire 11 or by any other element.

The conducting means 2 are accommodated within an outer enclosure 12, which is advantageously formed by a first shell 12*a* and by a second shell 12*b*, which can be fastened together by way of the action of elastic teeth 14 formed on the first shell 12*a*, which engage in complementary teeth 15 formed on the second shell 12*b*.

The coupling is practically irreversible and it is optionally possible to provide a suitable tool that allows authorized personnel to open the two shells, such opening being instead impossible for ordinary users.

For the sake of completeness in description, it should also be noted that the shells 12*a* and 12*b* form recesses 16 for the passage of the electrical power supply cable or cables and of any supporting cable 6.

There are also other channels 16*b*, which are closed by breakable walls 17 that can be removed if a plurality of cables are used.

An important particularity of the invention is constituted by the fact that safety means are provided that prevent recoupling of the connector 10 to the contact 7 once uncoupling between the connector 10 and the contact 7 has been performed or once the connector 10 has been extracted from the outer enclosure 12.

Such safety means are provided by an arc-like spring 20, which is provided with branches 20*a* that end with folds 20*b* for its insertion and retention in hollows 21 formed in one of the shells 12*a* or 12*b*.

During installation it is possible to connect the connector 10 and the contact 7, and when the shells are closed by means of a pair of pliers or by means of a specifically provided tool, the arc-like spring 20 is compressed in its central portion and is arranged substantially as shown in FIG. 4.

If the connector 10 is extracted from the enclosure 12 and therefore the electrical connection with the contact 7 is removed, the spring 20 is rearranged in its arc-like position and its central portion is arranged in the channel for the insertion of the connector 10 in a region located in front of the contact.

The spring 20 is in fact arranged between the free end of the contact 7 and the opening 24 for the insertion of the connector 10, so that once uncoupling has been performed, it is no longer possible to insert the connector 10 except by opening the enclosure 12, and this is not possible or is optionally possible only for authorized individuals possessing a specifically provided opening tool.

With reference to FIGS. 8 to 13, a second embodiment is shown in which there is again an outer enclosure that optionally has a different shape, is again designated by the reference numeral 12, and is formed by a first shell 12*a* and 12*b* to which a cable retainer 40 is connected, the retainer engaging the cable 41 of the connector, which is again designated by the reference numeral 10.

The safety means are provided by means of a movable partition, which is constituted by a bridge 50 that is provided with lateral feet 51 on which pusher springs 52 act.

The bridge 50 is slidingly guided on a plane that is substantially perpendicular to the direction of insertion of the connector 10, and is shaped so as to overlap the connector when the connector 10 is inserted in the shell 12*b* with its connection to the contact 7 and the enclosure 12*a* is then closed by means of the coupling of pins provided with an enlarged head 55 in corresponding seats 56 formed in the opposite shell.

In these conditions, the partition 50 is superimposed on the connector 10 and allows its extraction.

Once extraction has been performed, the springs 52 push the partition 50 so that its central portion 50*a* is arranged at the opening for insertion within the enclosure, and therefore it is no longer possible to reinsert the connector in the enclosure.

With reference to FIGS. 14 to 18, a third embodiment is illustrated which is conceptually related to the preceding ones, the difference being that the safety means are provided by means of a locking pin 60, which is arranged on the insertion path of the connector 10, thus forcing the connector to follow, for connection to the contact 7, a labyrinth-like path, which is not possible when the enclosure 12 is in the closed position.

Figure 17:
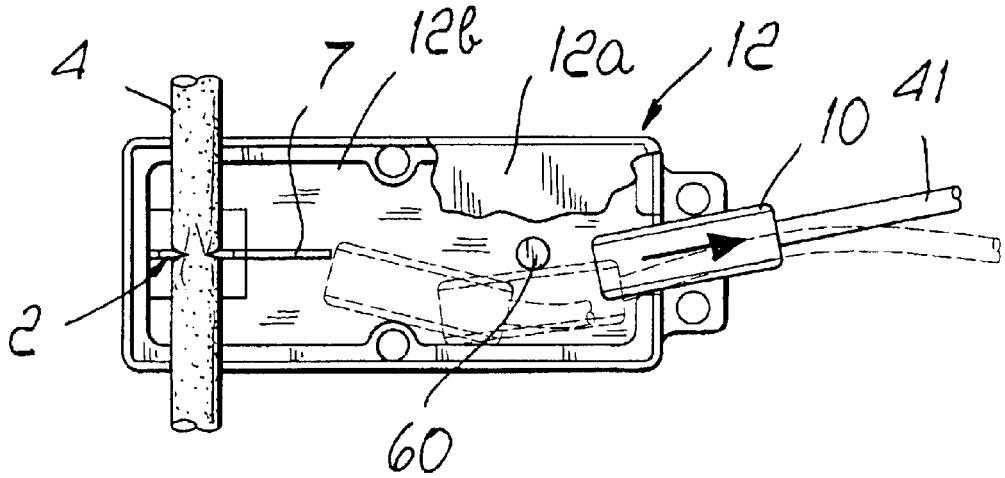
FIG. 17 is a view of the step for the extraction of the connector.
Figure 18:
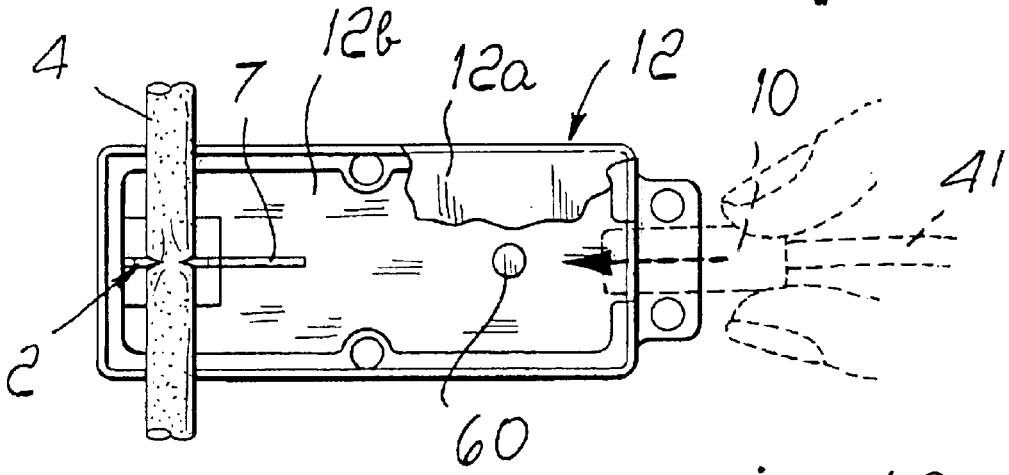
FIG. 18 is a plan view, showing that it is impossible to perform the connection inside the enclosure once the conductor and the connector have been uncoupled.
Figure 19:
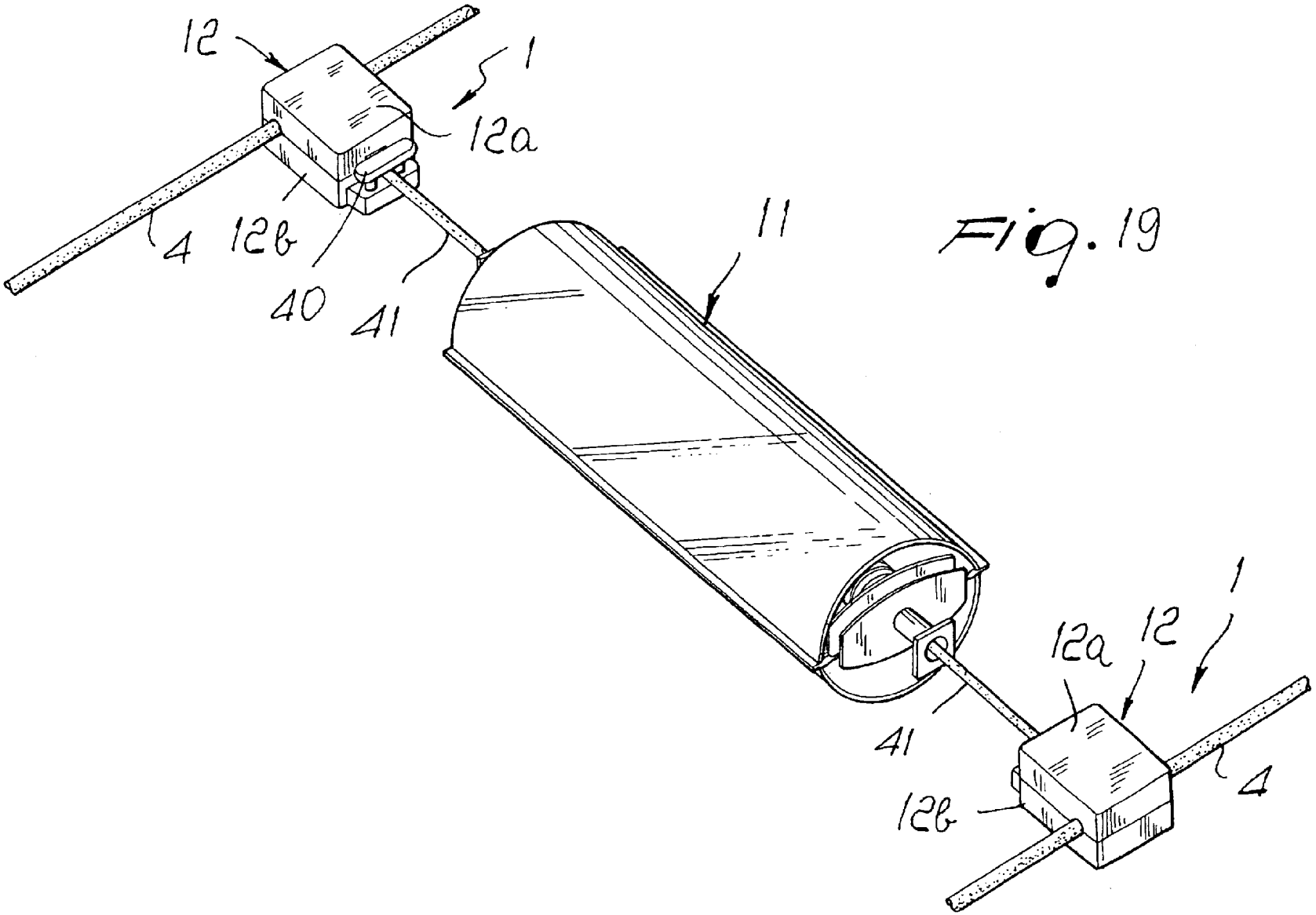
FIG. 19 is a schematic view of a luminaire connected to a pair of devices according to the invention.

Accordingly, it is possible to connect the connector 10 to the contact 7 with the shells 12*a* and 12*b* in the open position, but once extraction has been performed, as shown in FIG. 17, it is no longer possible to perform the connection, since it is not possible to insert the connector 10 on the contact 7.

It is thus evident from the above description that the invention achieves the intended aim and objects, and in particular the fact is stressed that a device is provided in which it is possible to remove the connector for connecting the electrical load but, once extraction has been performed, it is no longer possible to reconnect the connector to the contact, unless it is possible to open the enclosure, and this can be possible only when allowed and in any case only for personnel possessing the specifically provided tool that allows to perform the opening.

The invention thus conceived is susceptible of numerous modifications and variations, all of which are within the scope of the appended claims.

All the details may further be replaced with other technically equivalent elements.

Moreover, in the examples of embodiment described, individual characteristics, given in relation to specific examples, may actually be interchanged with other different characteristics that exist in other examples of embodiment.

The disclosures in Italian Patent Application No. M12002A002257 from which this application claims priority are incorporated herein by reference.

What is claimed is:

1. A device for connecting an electrical load to an insulated power supply cable, comprising conducting means that can be coupled electrically to an electrical conductor of an insulated cable and form at least one contact for connection to a connector for an electrical load, said conducting means being accommodated within an outer enclosure made of electrically insulating material constituted by shells that can be fastened together, wherein it comprises safety means that are adapted to prevent said connector from being recoupled to said contact once uncoupling has been performed inside said outer enclosure.

2. The device according to claim 1, wherein said safety means comprise an arc-like spring provided with branches that can be inserted in hollows formed in one of said shells, the central portion of said arc-like spring being superimposable on said connector when said connector is connected to said contact and being arrangeable in a channel for inserting the connector, in a region located in front of said contact, when said connector is uncoupled from said contact.

3. The device according to claim 2, wherein said arc-like spring has portions that are folded at the end of its branch for detachable retention in the hollows formed in the corresponding shell.

4. The device according to claim 2, wherein said safety means comprise a partition that can move on a plane that is substantially perpendicular to the channel for the insertion of said connector.

5. The device according to claim 4, wherein said movable partition comprises a bridge that is provided with lateral feet on which pusher springs act, said bridge being slidingly guided on said plane that is substantially perpendicular to the channel for the insertion of said connector and having a central portion that can be superimposed on said connector, when the connector is coupled to said contact, and can be arranged in the channel for the insertion of said connector when the connector is uncoupled from said contact.

6. The device according to claim 5, wherein said bridge is provided with lateral feet on which pusher springs act.

7. The device according to claim 1, wherein said safety means have a locking pin that is interposed along an insertion path of said connector, said connector being disengageable from said contact with a labyrinth-like path that is adapted to prevent the recoupling of said container with said contact.

8. The device according to claim 1, wherein said outer enclosure is constituted by two shells that can be fastened together and can be separated only by means of a specifically provided tool.

9. A device for connecting an electrical load to an insulated power supply cable, comprising conducting means that can be electrically coupled to an electrical conductor of an insulated cable and form at least one contact for connection to a connector for an electrical load, said conducting means being accommodated within an outer enclosure made of electrically insulating material constituted by shells that can be fastened one another, further comprising safety means that are adapted to prevent said connector from being recoupled to said contact once said connector has been extracted from said outer enclosure.

10. The device according to claim 9, wherein said safety means comprise an arc-like spring provided with branches that can be inserted in hollows formed in one of said shells, the central portion of said arc-like spring being superimposable on said connector when said connector is connected to said contact and being arrangeable in a channel for inserting the connector, in a region located in front of said contact, when said connector is uncoupled from said contact.

11. The device according to claim 10, wherein said arc-like spring has portions that are folded at the end of its branch for detachable retention in the hollows formed in the corresponding shell.

12. The device according to claim 10, wherein said safety means comprise a partition that can move on a plane that is substantially perpendicular to the channel for the insertion of said connector.

13. The device according to claim 12, wherein said movable partition comprises a bridge that is provided with lateral feet on which pusher springs act, said bridge being slidingly guided on said plane that is substantially perpendicular to the channel for the insertion of said connector and having a central portion that can be superimposed on said connector, when the connector is coupled to said contact, and can be arranged in the channel for the insertion of said connector when the connector is uncoupled from said contact.

14. The device according to claim 13, wherein said bridge is provided with lateral feet on which pusher springs act.

15. The device according to claim 9, wherein said safety means have a locking pin that is interposed along an insertion path of said connector, said connector being disengageable from said contact with a labyrinth-like path that is adapted to prevent the recoupling of said container with said contact.

16. The device according to claim 9, wherein said outer enclosure is constituted by two shells that can be fastened together and can be separated only by means of a specifically provided tool.

* * * * *